US005766118A

United States Patent [19]

Conner

[11] Patent Number: 5,766,118

[45] Date of Patent: Jun. 16, 1998

[54] APPARATUS FOR EXERCISING ABDOMINAL MUSCLES

[76] Inventor: Gary W. Conner, 1484 Fairway Dr., Newton, N.C. 28658

[21] Appl. No.: 710,169

[22] Filed: Sep. 12, 1996

Related U.S. Application Data

[60] Provisional application No. 60/008,814, Dec. 18, 1995.

[51] Int. Cl.[6] ..... A63B 00/69

[52] U.S. Cl. ..... 482/129; 482/904; 482/121

[58] Field of Search ..... 482/121–130, 482/904

[56] References Cited

U.S. PATENT DOCUMENTS

| | | | |
|---|---|---|---|
| 1,432,013 | 10/1922 | Blake | 482/124 |
| 4,116,434 | 9/1978 | Bernstein . | |
| 4,762,318 | 8/1988 | Phillips et al. | 482/126 |
| 5,098,089 | 3/1992 | Harrington . | |
| 5,120,052 | 6/1992 | Evans . | |
| 5,250,016 | 10/1993 | Higgins | 482/121 |
| 5,328,435 | 7/1994 | Ricks . | |

FOREIGN PATENT DOCUMENTS

| | | | |
|---|---|---|---|
| 0090092 | 10/1983 | European Pat. Off. | 482/904 |
| 0016404 | 9/1900 | United Kingdom | 482/129 |
| 2227949 | 8/1990 | United Kingdom | 482/129 |

OTHER PUBLICATIONS (FR) Laurent Mar. 3, 1906 Figs 1 and 2 of Specification.

*Primary Examiner*—Jerome Donnelly

*Attorney, Agent, or Firm*—Dougherty & Dremann

[57] ABSTRACT

An exercise apparatus includes a clamping means for fixing the apparatus to a vertical surface such as a door or a wall, an elastic resistance band and a resistance harness. In a preferred embodiment, the clamping means includes a lag screw having a hook portion adjacent one end. One end of the resistance band is attached to the hook portion of the lag screw and the other end is attached to the resistance harness. In another preferred embodiment, the exercise apparatus further includes an adjustment means for adjusting the vertical location of the resistance harness relative to the clamping means, and the clamping means includes a U-shaped Bracket. The adjustment means includes a belt having one end attached to the U-shaped bracket, and the free end threaded first through an adjustment buckle and then through a hook attached to one end of the resistance band. The other end of the resistance band is attached to the resistance harness. In a preferred method of using the exercise apparatus, a user extends the upper arms through an opening defined by the resistance harness and rotates the upper body about the pelvis while pulling the resistance harness in the direction of the pelvis using the abdominal muscles to extend the resistance band. In another preferred method, the user pulls on the resistance harness in the direction of the pelvis using the abdominal muscles to extend the resistance band without rotating the upper body about the pelvis. Thus, the spine is elongated and all of the abdominal muscle groups are contracted without placing undue stress on the muscles in the lower back.

3 Claims, 4 Drawing Sheets

11
20
22
31
30
12
10
32
41
40
53
42
51
52
50
56
59
56
54
58
57

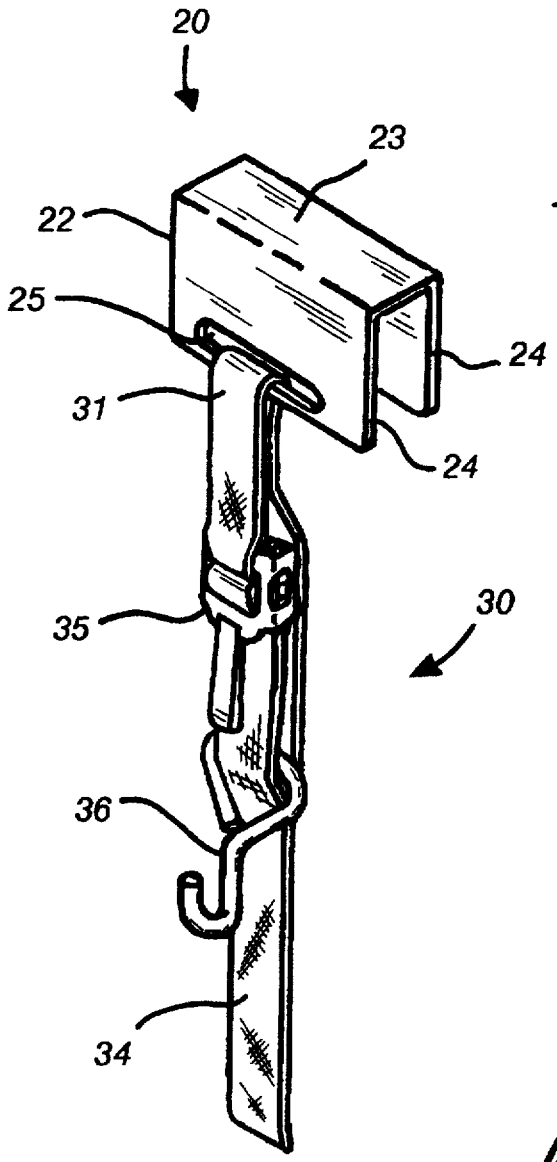
Fig.4
Fig.5
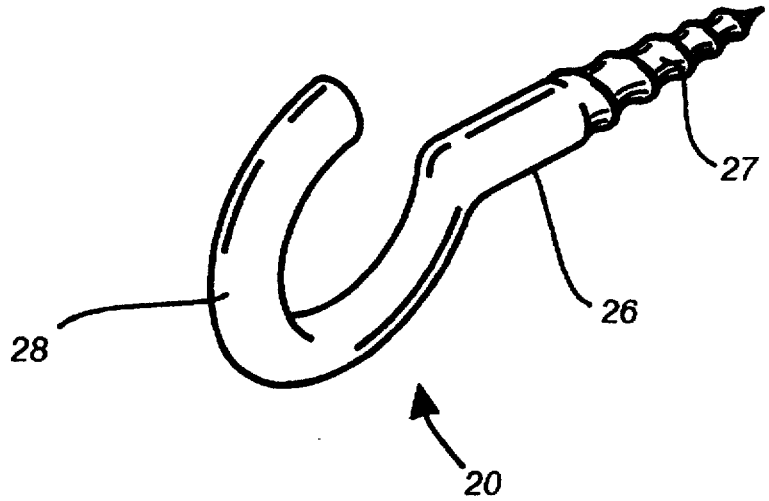

APPARATUS FOR EXERCISING ABDOMINAL MUSCLES

RELATED APPLICATIONS

This application claims the benefit of U.S. Provisional application Ser. No. 60/008,814 filed Dec. 18, 1995.

FIELD OF THE INVENTION

The invention relates to an exercise apparatus, and more particularly, to an apparatus for exercising the abdominal muscles.

BACKGROUND OF THE INVENTION

Situps have long been a popular exercise for strengthening and toning the abdominal muscles. Typically, a person performing a situp lies with the back and feet on a flat surface, and with the knees bent. The person then lifts the head and shoulders in the direction of the knees using the abdominal muscles. The hands may be placed behind the head with the elbows forward so that the elbows touch the knees when the head and shoulders are lifted. The conventional situp, however, places undue stress on the muscles in the lower back, causing discomfort during the exercise and often resulting in an injury.

As a result, the "crunch" style of situp has become a popular alternative to the conventional situp. Crunches are performed in the same manner as conventional situps except that the head and shoulders are lifted only a limited distance so that less range of motion is required by the muscles in the lower back. Accordingly, the undue stress placed on the muscles in the lower back is not eliminated, but only reduced. In addition, crunches do not optimize the exercise benefit received by the abdominal muscles. In particular, the exercise benefit is lost which is obtained by pulling the weight of the head and shoulders the additional distance in the direction of the knees.

A number of weight and "fitness" apparatus have been developed recently for exercising the abdominal muscles. These apparatus, however, for the most part reproduce the same range of motion as the situp and the crunch. Namely, the resistance produced by the apparatus is concentrated in the lower back and the upper body of the person using the apparatus. One such exercise apparatus is disclosed in U.S. Pat. No. 5,098,089 issued Mar. 24, 1992 to Harrington et al. The Harrington exercise apparatus includes a triangular frame for mounting a bed on which the body of the user is supported, knee posts for supporting the knees of the user, and foot posts for receiving the feet and ankles of the user. The frame acts as a fulcrum so that the bed pivots about a transverse axis to permit the user to perform situps with the head elevated above the feet. Accordingly, the user obtains the exercise benefit of the full range of motion of a conventional situp without having to overcome the force of gravity to raise the upper body above the elevation of the feet and knees. Although the Harrington exercise apparatus alleviates a portion of the undue stress placed on the muscles in the lower back, it does not increase the exercise benefit obtained by the abdominal muscle groups.

U.S. Pat. No. 5,120,052 issued Jun. 9, 1992 to Evans discloses an abdominal exercise apparatus that develops the abdominal muscles through their entire ranges of motion. The objective of the apparatus is to develop the abdominal muscles not only through contraction, but through increased elongation as well. The apparatus includes a convex arch which engages the upper lumbar and lower thoracic spine in the area of the lower back of the user. The arch permits the user's spine to be supported while allowing the spine to arch beyond the range that occurs in a normal standing posture. The apparatus further includes an adjustable knee retainer that restrains upward movement of the knees so that the lower back maintains contact with the arch. Accordingly, the range of motion experienced during the situp is increased so that the abdominal muscles are elongated as well as contracted during the exercise. Although the Evans apparatus alleviates a portion of the undue stress placed on the muscles in the lower back and increases the exercise benefit obtained by the muscles in the lower back, it does not significantly increase the exercise benefit obtained by the abdominal muscle groups.

U.S. Pat. No. 5,328,435 issued Jul. 12, 1994 to Ricks discloses an exercise apparatus for building stronger stomach muscles. The apparatus includes a pair of foot rests for anchoring the feet of the user in a vertical or inclined orientation. The foot rests immobilize the feet of the user while the user performs a conventional situp. Accordingly, the exercise benefit obtained by the abdominal muscles is somewhat increased by the additional resistance provided by the foot rests. However, the Ricks exercise apparatus places undue stress on the muscles in the lower back, and only some of the abdominal muscles obtain an increased exercise benefit (i.e., the muscles utilized in performing a conventional situp).

Each of the above exercise apparatus place undue stress on the muscles in the lower back and do not provide optimum exercise benefit to all of the abdominal muscle groups. It is apparent that an exercise apparatus that overcomes one or more of the limitations of the exercise apparatus described above would be advantageous. In particular, it would be advantageous to provide an exercise apparatus which focuses the benefit of the exercise on all of the abdominal muscle groups, and which does not place undue stress on the muscles in the lower back of the user.

Accordingly, it is an object of the invention to provide an exercise apparatus which works all of the abdominal muscles groups.

It is another object of the invention to provide an exercise apparatus which does not place undue stress on the muscles in the lower back of the user.

It is another, and more particular, object of the invention to provide an exercise apparatus which causes all of the abdominal muscle groups to contract in the direction of the posterior side of the user's body. The invention disclosed and shown in the accompanying figures provides such an exercise apparatus including additional features which will be more fully described hereinafter.

SUMMARY OF THE INVENTION

The invention is an exercise apparatus for developing the abdominal muscle groups and elongating the spine of the user without placing undue stress on the muscles in the lower back of the user. The apparatus accomplishes the above objective by providing for a range of motion of at least about 90 degrees while the abdominal muscle groups are contracted in the direction of the posterior side of the user's body. The apparatus may be used for toning and conditioning the abdominal muscles, and may be used to rehabilitate the spine while relieving the pressure normally exerted on the muscles in the lower back.

The exercise apparatus includes a clamping means for fixing the apparatus to a vertical surface, at least one resistance band and a resistance harness. In a preferred embodiment, one end of the resistance band is attached to the clamping means, and the other end of the resistance band is attached to the resistance harness. In another preferred embodiment, the exercise apparatus further includes an adjustment means for adjusting the exercise apparatus vertically to accommodate persons of different heights. One end of the adjustment means is attached to the clamping means and the other end is attached to one end of the resistance band. The other end of the resistance band is attached to the resistance harness.

In a preferred embodiment, the clamping means includes a U-shaped bracket made of a thin, formable material, such as sheet metal or plastic. The inside surface of the bracket engages the top edge of a conventional door so that the exercise apparatus hangs freely from the door under the influence of gravity, but is resisted against downward movement. The bracket includes a base and a pair of spaced apart legs depending from the base. An elongate slot is formed in at least one of the legs of the bracket for receiving one end of the adjustment means.

In an alternative embodiment, the clamping means includes an elongate lag screw for engaging a vertical wall. The lag screw includes an externally threaded portion adjacent one end for threading the clamping means into the vertical wall. A hook portion is formed adjacent the other end of the lag screw for accepting one end of the resistance band. A triangular shaped fitting, or a fitting having a slot formed therein, may be provided adjacent the other end of the lag screw instead of the hook portion so that one end of the adjustment means may be attached to the clamping means and the other end attached to the resistance band as previously described.

The adjustment means preferably includes a thin, narrow, elongate adjustment belt made of a substantially non-elastic material, such as fabric or soft plastic. One end of the belt is threaded first through the slot formed in the bracket of the clamping means, and next through an adjustment buckle. The end of the belt is then secured to itself in any conventional manner. The free end of the belt is threaded first through a hook for engaging the one end of the resistance band, and next through the opposite side of the adjustment buckle. The elevation of the hook relative to the bracket may be increased or decreased as required by feeding the free end of the adjustment belt through the adjustment buckle in a known manner.

The resistance band preferably includes a thin, narrow, elongate band made of an elastic material, such as rubber, which is formed into a closed loop. As previously described, one end of the resistance band is attached to the hook portion of the clamping means, or to the hook of the adjustment means. The other end of the resistance band is then attached to the resistance harness. A plurality of resistance bands may be used to increase the cumulative amount of resistance-against downward movement provided by the exercise apparatus, or to restrict the range of motion experienced by the user during the exercise.

The resistance harness preferably includes attachment means for attaching the resistance harness to the resistance band, an elongate resistance bar for receiving the upper arms of the user thereon, and at least one connecting strap for connecting the resistance bar to the attachment means. The attachment means preferably includes a thin, elongate rod having a hook portion extending outwardly from the rod for engaging the resistance band. The connecting strap preferably includes a pair of connecting straps, each having one end secured to an end of the rod of the attachment means and a second end secured to an end of the resistance bar. The resistance bar preferably includes a thin, elongate inner bar made of a rigid material, such as metal or hard plastic, and a thick, elongate outer pad disposed concentrically about the inner bar and made of a flexible material, such as soft rubber or polyvinylchloride (PVC) foam.

The exercise apparatus of the invention exercises the abdominal muscle groups and elongates the spine of the user without placing undue stress on the muscles in the lower back of the user. The exercise apparatus is secured to a vertical surface, such as a door or a wall by the clamping means. The user is preferably seated on a chair or bench with the upper arms extended through the resistance harness and resting on the outer pad of the resistance bar. The user adjusts the vertical location of the exercise apparatus (if necessary) using the adjustment means so that the user's back is straight and the resistance band is relaxed, but taut.

In a preferred method of using the exercise apparatus, the user rotates the upper body about the pelvis and pulls the resistance bar in the direction of the pelvis using the abdominal muscles while tilting the pelvis so that the abdominal muscle groups are contracted and the spine is elongated. The exercise apparatus permits the user to rotate the upper body forward through a range of motion up to about 90 degrees so that the spine is elongated without the muscles in the lower back having to overcome the influence of gravity to raise the upper body above the elevation of the feet and knees. The user than rotates the upper body back to the upright position while relieving the downward pressure on the resistance bar so that the tension in the resistance band is relaxed.

In another preferred method of using the exercise apparatus, the user pulls the resistance bar in the direction of the pelvis using the abdominal muscles while tilting the pelvis so that the abdominal muscle groups are contracted and the spine is elongated, without rotating the upper body about the pelvis. The resistance in the opposite direction provided by the extension of the resistance band exercises all of the abdominal muscles groups in contraction as opposed to extension. The user than relieves the downward pressure on the resistance bar so that the tension in the resistance band is relaxed.

BRIEF DESCRIPTION OF THE DRAWINGS

While some of the objects and advantages have been stated, others will become apparent as the preferred embodiments of the invention are described in connection with the accompanying drawings in which:

FIG. 4 illustrates a preferred embodiment of the clamping means and the adjustment means of the invention; and FIG. 5 illustrates another preferred embodiment of the clamping means of the invention.

DETAILED DESCRIPTION OF THE PREFERRED EMBODIMENTS

Figure 1:
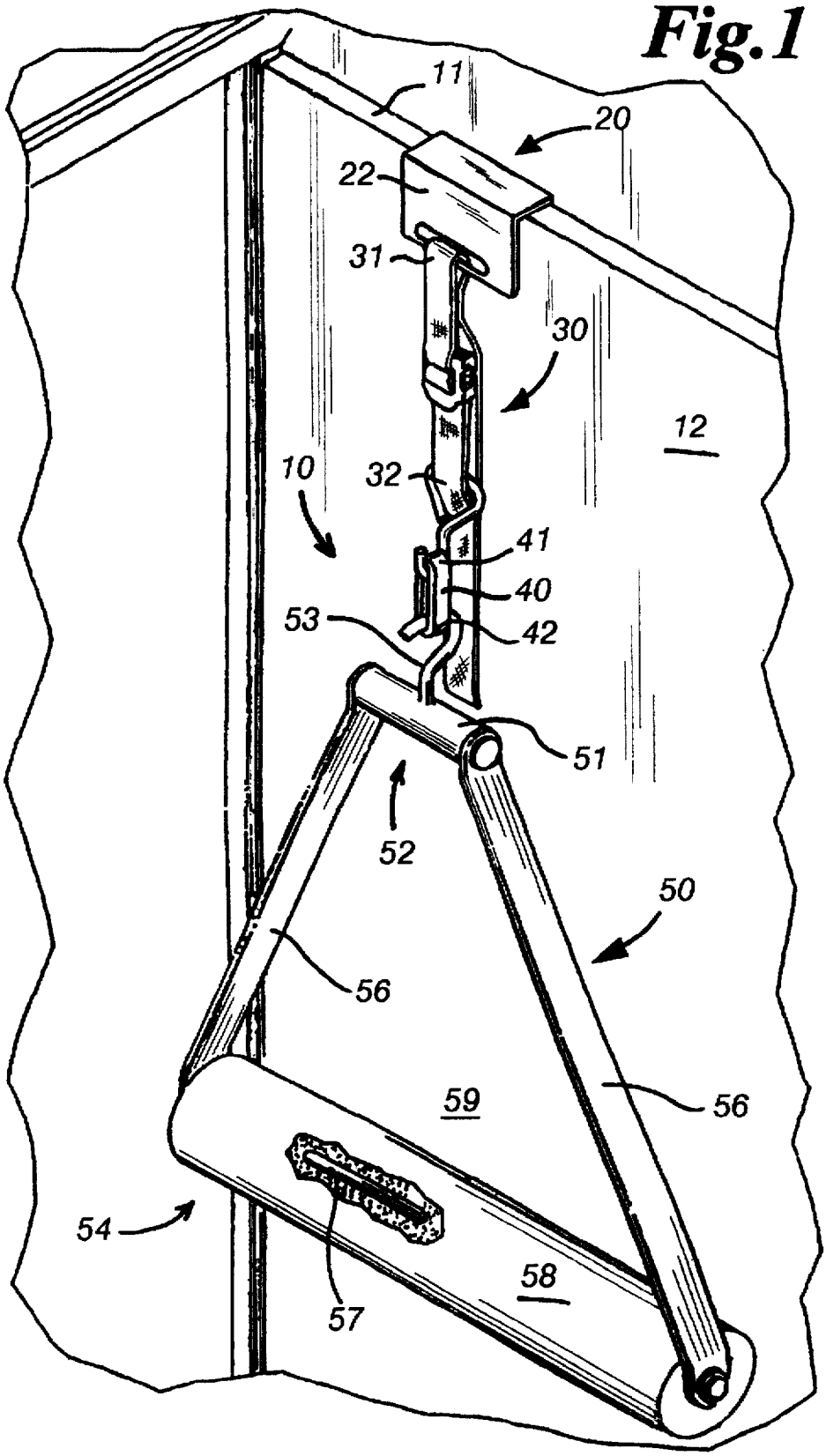
FIG. 1 is an environmental perspective view of an exercise apparatus according to the invention.

Referring now to the drawings, wherein like numerals indicate like elements, FIG. 1 is an environmental view of a preferred embodiment of an exercise apparatus, indicated generally at 10, according to the invention. The exercise apparatus 10 enables a user to develop the abdominal muscle groups and elongate the spine without placing undue stress on the muscles in the lower back. The exercise apparatus 10 provides for a range of motion of at least about 90 degrees while the abdominal muscle groups are contracted in the direction of the posterior side of the user's body. Thus, the apparatus 10 may be used for toning and conditioning the abdominal muscles, and may be used to rehabilitate the spine while relieving the pressure normally exerted on the muscles in the lower back.

The apparatus 10 comprises clamping means 20 for fixing the exercise apparatus 10 to a vertical surface, at least one resistance band 40 and a resistance harness 50. In a preferred embodiment (FIGS. 2*a* and 2*b*), one end 41 of the resistance band 20 is attached directly to the clamping means 40, and the other end 42 of the resistance band is attached to the resistance harness 50. In another preferred embodiment (FIGS. 3*a* and 3*b*), the exercise apparatus 10 further comprises an adjustment means 30 for adjusting the exercise apparatus vertically to accommodate persons of different heights. One end 31 of the adjustment means 30 is attached directly to the clamping means 20, and the other end 32 of the adjustment means is attached to end 41 of the resistance band 40. As before, the end 42 of the resistance band 40 is attached to the resistance harness 50.

Figure 2B:
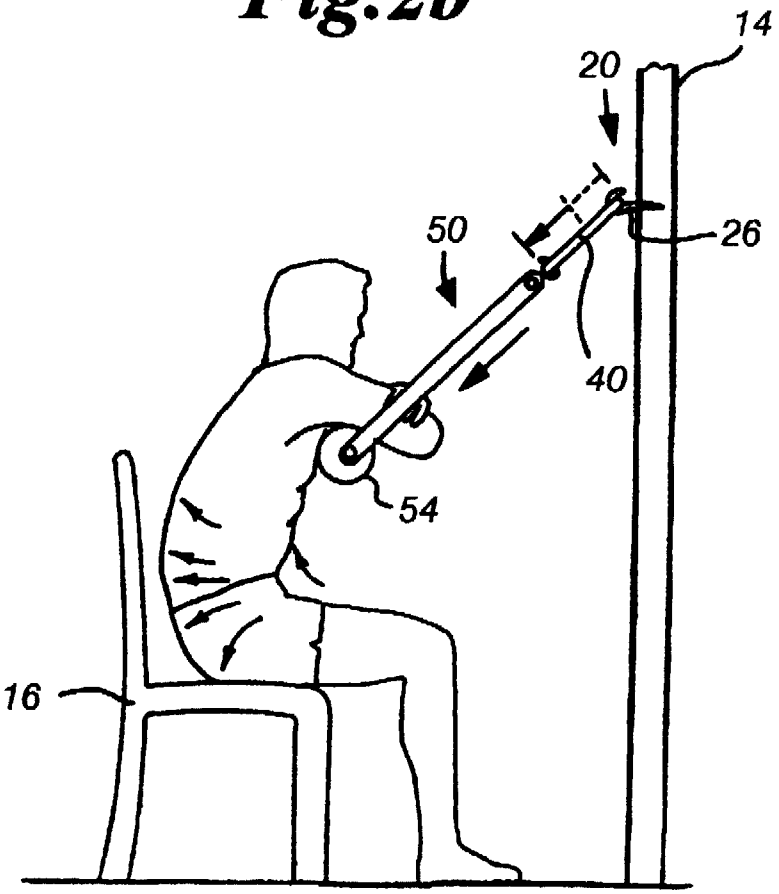
FIG. 2*b* illustrates another preferred method of using the preferred embodiment of the exercise apparatus of FIG. 2*a;*
Figure 2A:
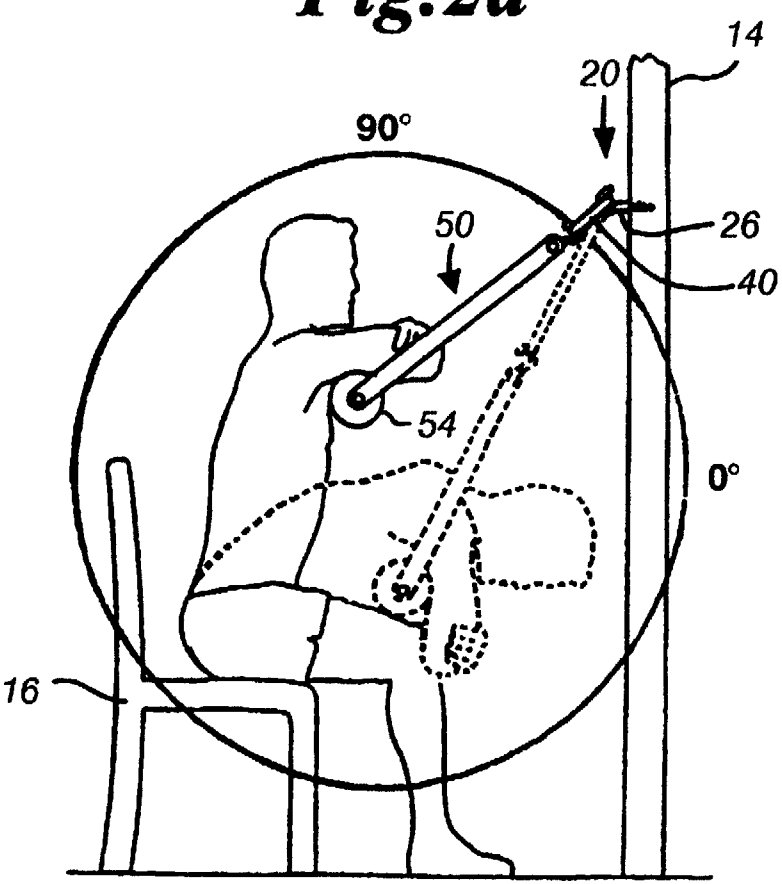
FIG. 2*a* illustrates a preferred method of using a preferred embodiment of an exercise apparatus according to the invention.
Figure 3B:
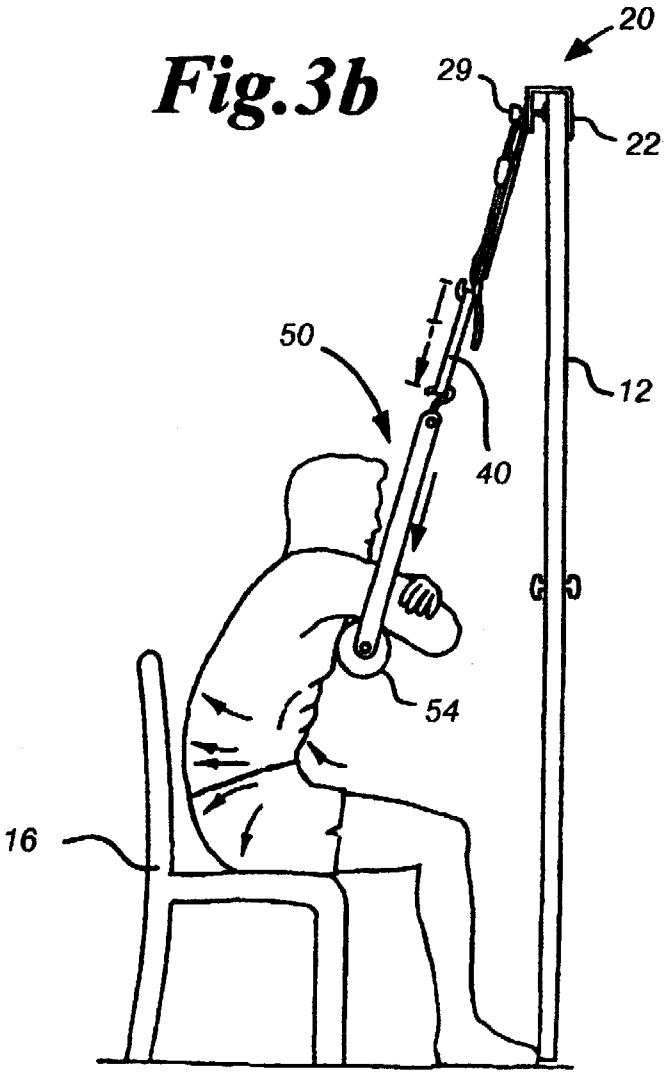
FIG. 3*b* illustrates the preferred method of FIG. 2*b* of using the preferred embodiment of the exercise apparatus of FIG. 1.
Figure 3A:
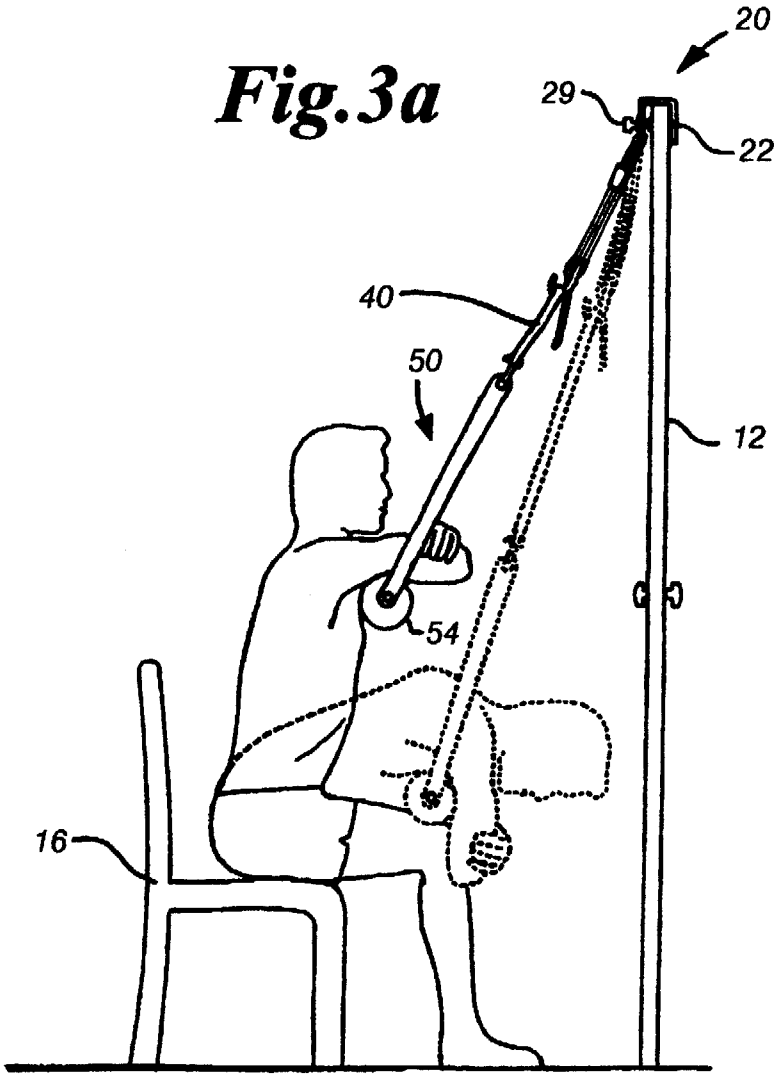
FIG. 3*a* illustrates the preferred method of FIG. 2*a* of using the preferred embodiment of the exercise apparatus of FIG. 1.

Clamping means 20 fixes the exercise apparatus 10 to a vertical surface, such as a door 12 (FIGS. 1, 3*a* and 3*b*) or to a wall 14 (FIGS. 2*a* and 2*b*). In a preferred embodiment, the clamping means 20 comprises a U-shaped bracket 22 made of a thin, formable material, such as sheet metal or plastic. The inside surface 21 of the bracket 22 engages the top edge 11 of a conventional door 12 so that the exercise apparatus 10 hangs freely from the door under the influence of gravity, but is resisted against downward movement. As best shown in FIG. 4, the bracket 22 preferably comprises a base 23 and a pair of spaced apart legs 24 depending from the base. An elongate slot 25 is formed in at least one of the legs 24 of the bracket 22 for receiving end 31 of adjustment means 30. As shown in FIG. 3*a* and FIG. 3*b*, a clamping screw 29 may be provided through an aperture formed in leg 24 to permit bracket 22 to be used with a door 12 which is less than standard thickness.

In an alternative embodiment, clamping means 20 comprises an elongate lag screw 26 made of a rigid material, such as metal or hard plastic, for engaging vertical wall 14. As best shown in FIG. 5, the lag screw 26 comprises an externally threaded portion 27 adjacent one end for threading the clamping means 20 into vertical wall 14. A hook portion 28 is formed adjacent the other end of the lag screw 26 for accepting end 41 of the resistance band 40. A triangular shaped fitting (not shown), or a fitting having a slot formed therein (not shown), may be provided adjacent the other end of the lag screw 26 instead of the hook portion 28 so that end 31 of adjustment means 30 may be attached to the clamping means 20 and end 32 of adjustment means 30 may be attached to end 41 of the resistance band 40 as previously described.

As best shown in FIG. 4, adjustment means 30 preferably comprises a thin, narrow, elongate adjustment belt 34 made of a substantially non-elastic material, such as fabric or soft plastic. One end of the belt 34 is threaded first through the slot 25 formed in bracket 22 of clamping means 20, and next through an adjustment buckle 35. The end of the belt 34 is then secured to itself in a conventional manner, such as by sewing, stapling or riveting. The free end of the belt 34 is threaded first through a hook 36 for engaging the end 41 of the resistance band 40, and next through the opposite side of adjustment buckle 35. Accordingly, adjustment means 30 connects the clamping means 20 to the resistance band 40 while permitting the user to adjust the location of the resistance harness 50 relative to the upper arms of the user. The elevation of the hook 36 relative to the bracket 22 may be increased or decreased as required by feeding the free end of the adjustment belt 34 through the adjustment buckle 35 in a known manner.

Resistance band 40 preferably comprises a thin, narrow, elongate band made of an elastic material, such as rubber, which is formed into a closed loop. As previously described, end 41 of the resistance band 40 is attached to the hook portion 28 of clamping means 20, or to the hook 36 of adjustment means 30. The end 42 of the resistance band 40 is attached to the resistance harness 50. Elastic resistance band 40 provides increasing resistance as the resistance harness 50 is pulled downward and the resistance band is extended. A plurality of resistance bands 40 may be used to increase the cumulative amount of resistance against downward movement provided by the exercise apparatus 10, or to restrict the range of motion experienced by the user during the exercise. Thus, as the abdominal muscles of the user strengthen, additional resistance bands 40 may be used to increase the exercise benefit obtained by the abdominal muscle groups. Preferably the plurality of resistance bands 40 each have the same length and elasticity. However, a plurality of resistance bands 40 may be provided having different lengths and/or elasticities so that a user may also vary the amount of extension provided by the resistance bands 40, and thus the amount of contraction experienced by the abdominal muscle groups.

Resistance harness 50 preferably comprises attachment means 52 for attaching the resistance harness to the resistance band 40, an elongate resistance bar 54 for receiving the upper arms of the user thereon, and at least one connecting strap 56 for connecting the resistance bar to the attachment means. The attachment means 52 is made of a rigid material, such as metal or hard plastic, and preferably comprises a thin, elongate rod 51 having a hook portion 53 extending outwardly from the rod for engaging the end 42 of the resistance band 40. The connecting strap 56 preferably includes a pair of connecting straps, each having one end secured to an end of the rod 51 of the attachment means 52, and a second end secured to an end of the resistance bar 54, so that the resistance bar is secured to the attachment means.

The resistance harness 50 defines a triangular opening 59 formed by the relatively short rod 51 of the attachment means 52, the connecting straps 56, and the relatively long resistance bar 54. Thus, a user may extend the upper arms through the opening 59 and position the upper arms over resistance bar 54 for a purpose to be described hereinafter. The resistance bar 54 preferably includes a thin, elongate inner bar 57 made of a rigid material, such as metal, hard plastic or a reinforced composite material, and a thick, elongate outer pad 58 disposed concentrically about the inner bar and made of a flexible material, such as soft rubber or polyvinylchloride (PVC) foam. The inner bar 57 provides stiffness to prevent the resistance bar 54 from bending under the force exerted by the upper arms of the user. Outer pad 58 provides a soft, resilient surface for supporting the upper arms of the user.

The exercise apparatus 10 permits a user to exercise the abdominal muscle groups and elongate the spine of the user without placing undue stress on the muscles in the lower back. As previously described, the exercise apparatus 10 is secured to a vertical surface, such as door 12 or wall 14, by the clamping means 20. The user is preferably seated on a bench or chair 16 with the upper arms extended through the opening 59 defined by the resistance harness 50 and resting on the outer pad 58 of the resistance bar 54. If necessary, the user first adjusts the vertical location of the exercise apparatus 10 using the adjustment means 30 so that the user's back is straight and the resistance band 40 is relaxed, but taut.

In a preferred method of using the exercise apparatus 10 illustrated in FIGS. 2*a* and 3*a*, the user rotates the upper body about the pelvis, as indicated by the dashed lines, and pulls the resistance bar 54 in the direction of the pelvis using the abdominal muscles while tilting the pelvis so that the abdominal muscle groups are contracted and the spine is elongated. The exercise apparatus 10 permits the user to rotate the upper body forward through a range of motion up to about 90 degrees so that the spine is fully elongated without the muscles in the lower back having to overcome the influence of gravity to raise the upper body above the elevation of the feet and knees. The user than rotates the upper body back about the pelvis to the upright position while relieving the downward pressure on the resistance bar 54 so that the tension in the resistance band 40 is relaxed. This preferred method of using the exercise apparatus 10 is particularly beneficial to rehabilitate the spine without placing undue stress on the muscles in the lower back.

In another preferred method of using the exercise apparatus 10 illustrated in FIGS. 2*b* and 3*b*, the user pulls the resistance bar 54 in the direction of the pelvis using the abdominal muscles while tilting the pelvis so that the abdominal muscle groups are contracted and the spine is elongated (as indicated by the arrows), without rotating the upper body about the pelvis. The resistance in the opposite direction provided by extension of the resistance band 40 (indicated by the dashed arrow) exercises all of the abdominal muscles groups in contraction as opposed to extension. The user then relieves the downward pressure on the resistance bar 54 so that the tension in the resistance band 40 is relaxed. This preferred method of using the exercise apparatus 10 is particularly beneficial to increase the degree of contraction of the abdominal muscle groups without placing undue stress on the muscles in the lower back.

From the foregoing detailed description, it is readily apparent that the preferred embodiments of the exercise apparatus 10 and the preferred methods of using the exercise apparatus disclosed herein permit a user to exercise all of the abdominal muscle groups and elongate the spine without placing undue stress on the muscles in the lower back. The exercise apparatus 10 increases the range of motion, and increases the degree of contraction of the abdominal muscle groups experienced by the user during the exercise.

It is to be understood that the preferred embodiments shown and described herein are merely illustrative of the best mode of the invention and the principals thereof. Thus, it is expected that modifications and additions may be made to the exercise apparatus by those skilled in the art without departing from the spirit and scope of the invention, which is therefore understood to be limited only by the scope of the appended claims.

That which is claimed is:

1. An apparatus for exercising the abdominal muscles comprising:

a U-shaped bracket for engaging the upper edge of a door, said bracket comprising a base and a pair of spaced apart legs depending outwardly therefrom, at least one of said pair of spaced apart legs having an elongate slot formed therein;

an elongate, substantially non-elastic adjustment belt having a first end secured in the slot of said bracket and a second end opposite said first end;

a first hook connected to said adjustment belt adjacent the second end;

at least one extensible, elastic resistance band having a first end mounted on said first hook and a second end opposite said first end, said resistance band being formed in a closed loop; and a single resistance harness comprising attachment means for attaching said resistance harness to the second end of said at least one resistance band, said attachment means comprising a second hook for mounting said resistance harness on the second end of said resistance band, an elongate resistance bar having opposed ends, said resistance bar comprising a rigid inner bar and a resilient outer pad disposed concentrically about said inner bar, and a pair of flexible substantially non-elastic connecting straps for connecting the opposed ends of said resistance bar to said attachment means of said resistance harness;

wherein said resistance bar is movable from a rest in the direction of a user's pelvis by a contraction of the abdominal muscles;

wherein said resistance harness defines a triangular opening adapted to receive the torso of the torso of the user therein, for permitting the user to position both arms on said resistance bar; and wherein said resistance band provides resistance for exercising the abdominal muscles in contraction.

2. A method of using the device of claim 1, said method comprising the steps of:

positioning the upper arms over a rigid resistance bar attached to one end of an elastic resistance band, the other end of the elastic resistance band secured to a vertical surface;

rotating the upper body about the pelvis; and pulling the resistance bar in the direction of the pelvis using the abdominal muscles while tilting the pelvis so that the abdominal muscles are contracted.

3. A method of using the device of claim 1 said method comprising the steps of:

positioning the upper arms over a rigid resistance bar attached to one end of an elastic resistance band, the other end of the elastic resistance band secured to a vertical surface; and pulling the resistance bar in the direction of the pelvis using the abdominal muscles while tilting the pelvis so that the abdominal muscles are contracted, without rotating the upper body about the pelvis.

* * * * *

UNITED STATES PATENT AND TRADEMARK OFFICE

CERTIFICATE OF CORRECTION

PATENT NO. : 5,766,118

DATED : June 16,1998

INVENTOR(S) : Gary W. Conner

It is certified that error appears in the above-identified patent and that said Letters Patent is hereby corrected as shown below:

In the Claims:

Column 8, line 31, after "rest", insert-- position--

Column 8, line 36, delete "of the torso".

Signed and Sealed this

Twenty-fifth Day of May, 1999

*Attest:*

Q. TODD DICKINSON

*Attesting Officer*

*Acting Commissioner of Patents and Trademarks*